US008142308B2

(12) United States Patent
Gillig

(10) Patent No.: US 8,142,308 B2
(45) **Date of Patent: *Mar. 27, 2012**

(54) SYSTEM OF GOLF CLUB PERFORMANCE ENHANCEMENT AND ARTICLES RESULTANT THEREFROM

(75) Inventor: John P. Gillig, Pompano Beach, FL (US)

(73) Assignee: Triple Tee Golf, Inc., Pompano Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/968,832

(22) Filed: Dec. 15, 2010

(65) Prior Publication Data

US 2011/0081987 A1 Apr. 7, 2011

Related U.S. Application Data

(63) Continuation of application No. 11/588,992, filed on Oct. 27, 2006, now Pat. No. 7,854,667, which is a continuation-in-part of application No. 10/818,899, filed on Apr. 3, 2004, now Pat. No. 7,128,660, which is a continuation-in-part of application No. 10/383,532, filed on Mar. 10, 2003, now abandoned, which is a continuation-in-part of application No. 09/849,522, filed on May 7, 2001, now Pat. No. 6,530,848.

(60) Provisional application No. 60/205,250, filed on May 19, 2000.

(51) Int. Cl.
*A63B 53/04* (2006.01)

(52) U.S. Cl. ..... 473/324; 473/334; 473/345; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 4,695,054 | A * | 9/1987 | Tunstall | 473/338 |
| 4,795,159 | A * | 1/1989 | Nagamoto | 473/338 |
| 4,811,949 | A * | 3/1989 | Kobayashi | 473/337 |
| 4,867,458 | A * | 9/1989 | Sumikawa et al. | 473/336 |
| 6,530,848 | B2 * | 3/2003 | Gillig | 473/334 |
| 7,108,609 | B2 * | 9/2006 | Stites et al. | 473/256 |
| 7,128,660 | B2 * | 10/2006 | Gillig | 473/324 |
| 7,223,180 | B2 * | 5/2007 | Willett et al. | 473/334 |
| 7,854,667 | B2 * | 12/2010 | Gillig | 473/334 |

* cited by examiner

*Primary Examiner* — Sebastiano Passaniti

(74) *Attorney, Agent, or Firm* — Melvin K. Silverman; Yi Li

(57) ABSTRACT

The performance of a golf club is enhanced through the provision of a void space behind a face plate and above a sole portion, to decrease club weight and provide single, or combinations, of selectable weighting elements within volumetric coordinates of an orthonormal matrix about the void space and entire club. The weighted coordinates are provided in response to ball strike, flight analysis and physiologic observation of the golf strike swing. Ball backspin, trajectory, penetration hook or slice, and ballooning may be modified through the use of definable combinations of weighting strategies and sub-strategies.

20 Claims, 15 Drawing Sheets

$(X_1 - X_3, Y_3, Z_1 - Z_2)$ $(X_1 - X_3, Y_2 - Y_3, Z_2)$

SYSTEM OF GOLF CLUB PERFORMANCE ENHANCEMENT AND ARTICLES RESULTANT THEREFROM

REFERENCE TO RELATED APPLICATIONS

This application is a continuation of application Ser. No. 11/588,992, filed Oct. 27, 2006, now U.S. Pat. No. 7,854,667, which is a continuation-in-part of application Ser. No. 10/818,899, filed Apr. 3, 2004, now U.S. Pat. No. 7,128,660 B2, which is a continuation-in-part of application Ser. No. 10/383,532, entitled Multi-purpose Golf Club, filed Mar. 10, 2003, now abandoned, which is a continuation-in part of application Ser. No. 09/849,522, filed on May 7, 2001, now U.S. Pat. No. 6,530,848, which claims the benefit under 35 USC 119(e) of Provisional Application No. 60/205,250, filed May 19, 2000. Each of said applications is incorporated by reference herein.

BACKGROUND OF THE INVENTION

A. Area of Invention

The invention relates to a system of selectably varying the center of gravity and distribution of weighting in a void space in the head of a golf club.

B. Prior Art

Golfing enthusiasts appreciate the dynamic characteristics of golf irons and woods and the manner in which performance of the same will vary as a consequence of physiologic characteristics of a particular golfer. Such physiologic factors will affect a variety of ball strike parameters including, without limitation, loft trajectory, inertial spin, range hook and slice.

Use of a cavity within the upper surface of a putter type golf club in to vary the weight or balance of the heel, toe and bottom portions of a putter club head, and certain uses of weights therein, is recognized in U.S. Pat. No. 5,683,307 (1997) to Rife, entitled Putter Type Golf Club Head with Balance Weight Configuration and Complementary Ball Striking Face. U.S. Pat. No. 3,841,640 (1974) to Gaulocher, entitled Golf Putter, reflects a rudimentary recognition of the importance of proper weighting within the head of a golf putter to compensate for physiologic needs and preferences of a golfer. Such approaches in the prior art have attempted to address one or another problem associated with the golf strike characteristics or, in some cases, the characteristics of the golf range surface. As is well known, golfing greens are replete with imperfections which affect ball speed, spin and roll. Accordingly, a wide range of both ball flight and ground surface performance factors can be attributed to weight distribution and position of the CG within the club head.

U.S. Pat. No. 4,909,029 (1990) to Sinclair employs an upper void space to modify the aerodynamics of the head of the golf ball.

U.S. Pat. No. 5,947,840 (1999) to Ryan relates to a golf club head having a single plane of a triangular shape by which weight distribution may be accomplished.

Published U.S. Specification US 2003/0199331A1 teaches use of a re-positionable weight chip in a golf club to modify club performance.

My issued U.S. Pat. No. 6,530,848 (2003) sets forth the use of weighting options for the center of gravity ("CG") of a club resultant from a substantial hollowing out of or void space in a top or predominant portion of the club head, as a manufacturing step. Said void space teaches the significance of placement of the position of a weight within such hollowed-out portion to effect a variety of ball strike and flight characteristics including increase or decrease of clockwise spin, counter-clockwise spin and back spin of the ball so propelled by the golf club. Said patent further sets forth the variability of a weight element at any point on top of the sole plate to adjust the weight of the golf club to induce a more desirable ball spin to thereby accomplish an improved trajectory of ball flight. My said U.S. patent also teaches the use of a selectable "inner concave surfaced weight" to achieve vertical (Z) axis, as well as sole plate level (xy plane) adjustability. As shown in FIG. 4 thereof, said FIG. 4 illustrates a sole plate having an inner concave surfaced weight as viewed from above. The sole plate has a rim which matches a ledge shown in FIG. 3 thereof. Four apertures are formed through the rim to secure the selectable concave weight to the rim.

U.S. Pat. No. 6,991,558 (2006) to Beach relates to a limited sub-set of the present system.

The present inventive system reflects my discovery that many more options for positioning of the CG and distribution of weight or weights within the head of a golf club, whether that club comprises an iron, a wood, or a hybrid thereof, exist in positioning, behind the club face, selectable high density weighting elements at coordinates of an orthonormal matrix up to 27 potential locations in a void space, to compensate for physiologic imperfections in one or more characteristic of the swing of a golfer. The angulation and curvature of the club face relative to said matrix provides a yet further performance enhancing parameter that co-acts with weight elements within said matrix.

SUMMARY OF THE INVENTION

The performance of golf club heads made of wood, plastic, metal, and composites thereof may be enhanced through the provision of a void space behind a face plate and above the sole portion, to decrease club weight and provide single or combinations of selectable weighting elements within volumetric coordinates of an orthonormal matrix within said void space. Said coordinates are provided as a function of ball strike, flight analysis and physiologic or computerized observation of the golf strike swing. In a basic embodiment, ball flight may be affected by varying the mass of a selectable sole portion which may be uniformly or variably weighted from the club hosel to toe end. Weight of uniform or non-uniform distribution may also selectably be provided within the void space behind the face plate and above the fixed sole portion. The angle and curvature of the face plate may also be varied.

The invention more particularly comprises a virtual X, Y, Z orthonormal coordinate system in which a sole portion is substantially congruent with a bottom-most XY plane thereof, in which a face plate is substantially congruent with a forward-most XZ plane thereof, and in which a heel and hosel side of the club head intersects a YZ plane thereof substantially at an origin of the coordinate system, and further in which an increase in X-axis value corresponds to a direction of a toe of the club head, an increase Y-axis value corresponds in direction to a rear of the club head, and an increase in Z-axis value corresponds to an increase in height above the sole portion. The golf club adjustment system comprises: (1) a club head having a void space behind the face plate of said club and above the sole portion thereof which void space is substantially conformal in geometry and volume to that of the club head; and (2) two selectable weighting means in which at least one weighting means thereof is not contiguous to any part of the face plate in which a selected value upon the Y-axis in any one of the weighting means does not equal a selected value of Y for a second of the weighting means, the selectable means comprising any two of: (a) weighting means substantially within the void space between a lower Y, lower Z coordinate, to increase backspin, to a higher Y, higher Z coordinate to decrease backspin; (b) weighting means substantially within the void space between a higher Y, higher Z coordinate, to maximize penetration, to a lower Y, lower Z coordinate, to minimize penetration; (c) weighting means substantially within the void space between a lower Z coordinate, to increase trajectory, to a higher Z-coordinate to decrease trajectory; or (d) weighting means substantially within the void space at a lower X coordinate, to compensate for hook, to a higher X-coordinate to compensate for slice.

In a further embodiment of the invention, a sole portion intersects a bottom-most XZ plane thereof, in which a face plate intersects a forward-most XY plane thereof, and in which a heel and hosel side of said club head intersects a YZ plane thereof substantially at an origin of said coordinate system, and further in which an increase in X-axis value corresponds to a direction of a toe of said club head, an increase in Y-axis value corresponds in direction to a rear of said club head, and an increase in Z-axis value corresponds to an increase in height above said bottom-most XY plane. The golf club adjustment system comprises: (a) a club head having a void space behind said face portion of said club and above said sole portion thereof; (b) weighting means substantially within said void space between a higher Y, higher Z coordinate, to minimize ballooning, to a lower Y, lower Z coordinate to maximize said ballooning; and (c) weighting means substantially within said void space between a lower X-coordinate, to compensate for hook, to a higher X-coordinate to compensate for slice.

It is an object of the invention to provide a golf club having a weight modifiable club head, inclusive of interchangeable sole portion and/or weighting elements, which express a universal method of golf club head modification to account for ball backspin, penetration, trajectory, and hook or slice.

It is another object to provide a wooden, plastic or metal golf club having a head with a hollowed out portion behind the face plate and above a uniform or non-uniform sole portion.

It is a further object of the invention to provide a golf club head with a hollowed-out void space, made during production, to a golfer's preference, and further providing a modifiable sole portion, with or without addition integral or added weights selectable positioned in volumetric coordinates of a virtual matrix about said void space.

It is a further object to provide a club head, modified with a hollow interior and having selectable point, axis, vector distributed linear or non-linear weights which may be inserted or removed to suit particular preferences, needs and physiologic requirements of a golfer.

It is a yet further object of the invention to provide improved elements and arrangements thru a method of providing an inexpensive, durable and effective means of compensating for ball spin, ball flight trajectory, ball spin and golf course surface variables.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
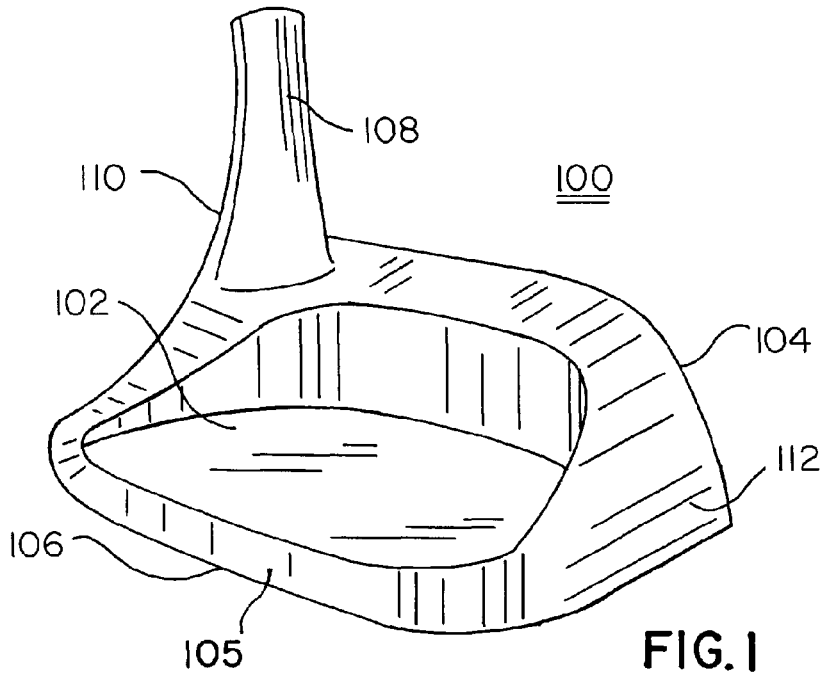
FIG. 1 is a perspective view of the head of a golf club configured for the practice of the present inventive method and products thereof.

With reference to the perspective view of FIG. 1, there is shown a golf club head 100 modified from the shape of more conventional golf club heads through the provision of a void space 102 behind a face plate 104 above a sole portion 106 of the club head 100. Said void space is substantially conformal in geometry and volume to said club head. Also shown in FIG. 1 is a golf club hosel 108 which enters the club head at a heel 110 of the club. Located oppositely to heel 110 is club toe 112. Also shown is trailing edge 105 of the club head.

Figure 2:
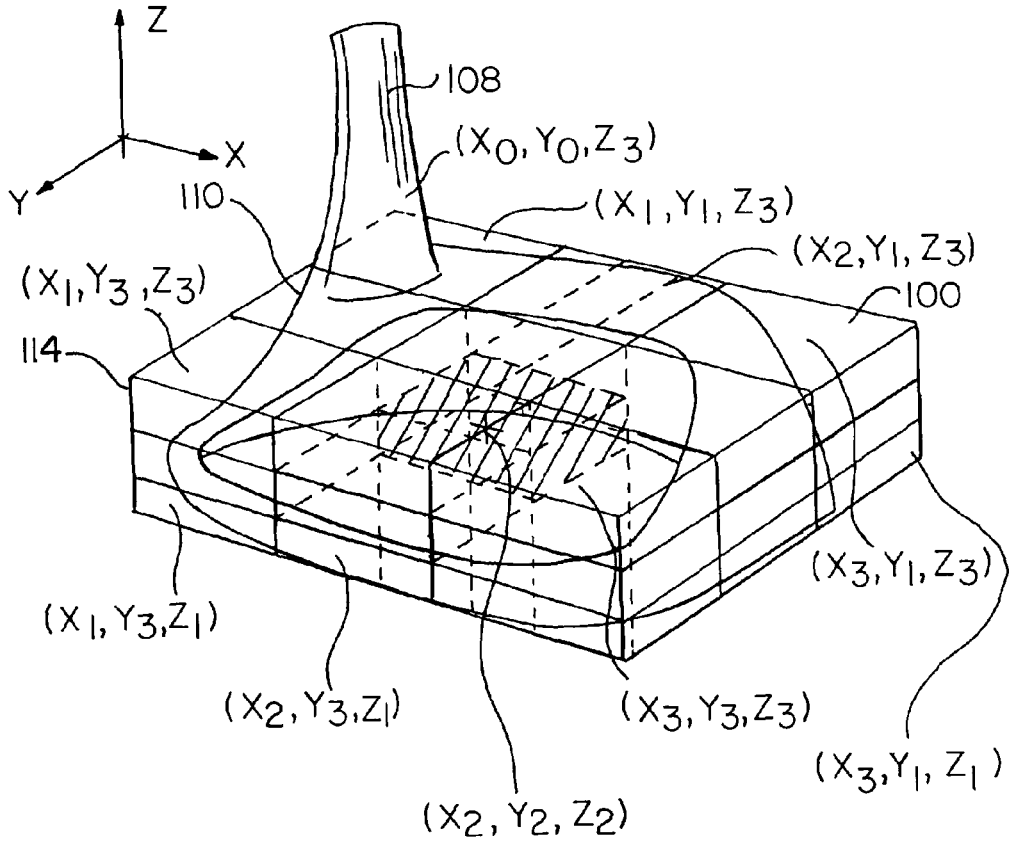
FIG. 2 is an illustration of a virtual three-dimensional orthonormal matrix by which the inventive method may be practiced.

In FIG. 2 is shown an orthonormal matrix 114 which surrounds the club head 100, and is defined by an X, Y and Z coordinate system corresponding to the three essential axes of the club head, shown to the upper left of FIG. 2. Said X, Y and Z axes of said orthonormal matrix 114 provide for a 3×3×3 system of 27 volumetric coordinates. Therein, the position (X0, Y0, and Z3) defines the location at which hosel 108 enters club head 100. The (X2, Y2, Z2) position, shown in shading in FIG. 2, represent the center of gravity of the club and is consistent with a normal or standard flight of the golf ball. In other words, a golfer having a perfect golf swing would, in accordance with the present system, apply a weighting element to a club head, of the type of club head 100, at position (X2, Y2, Z2) of the matrix shown therein. For ease of reference in the figures which follow, applicable coordinate nomenclature for various positions of said three 3×3×3 weighting system are also shown.

Figure 3:
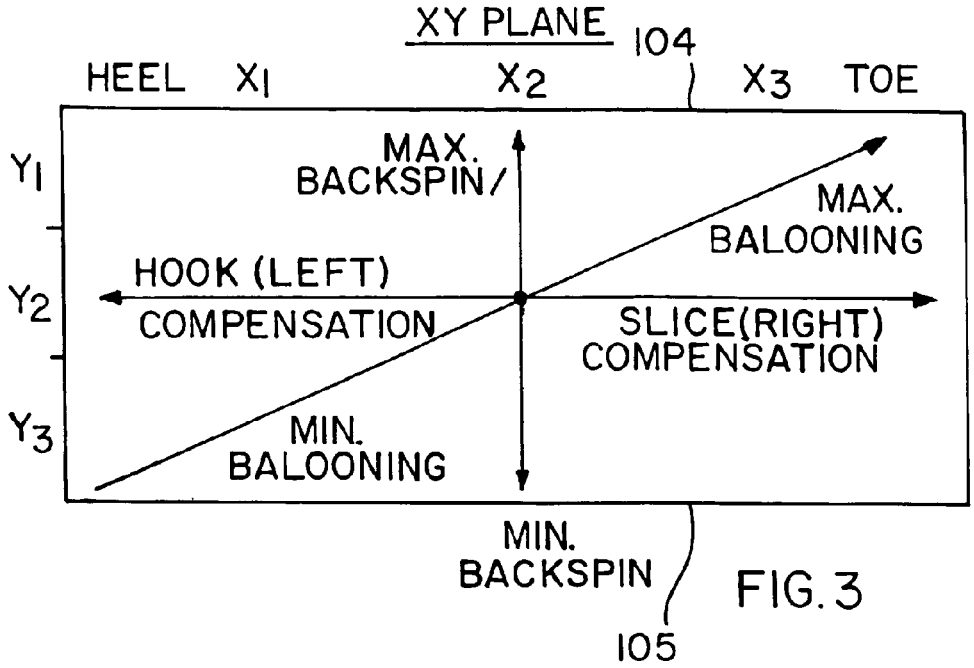
FIG. 3 is a graph-type illustration a golf club performance parameters which may be effected by weighting within the XY plane of said orthonormal matrix.
Figure 4:
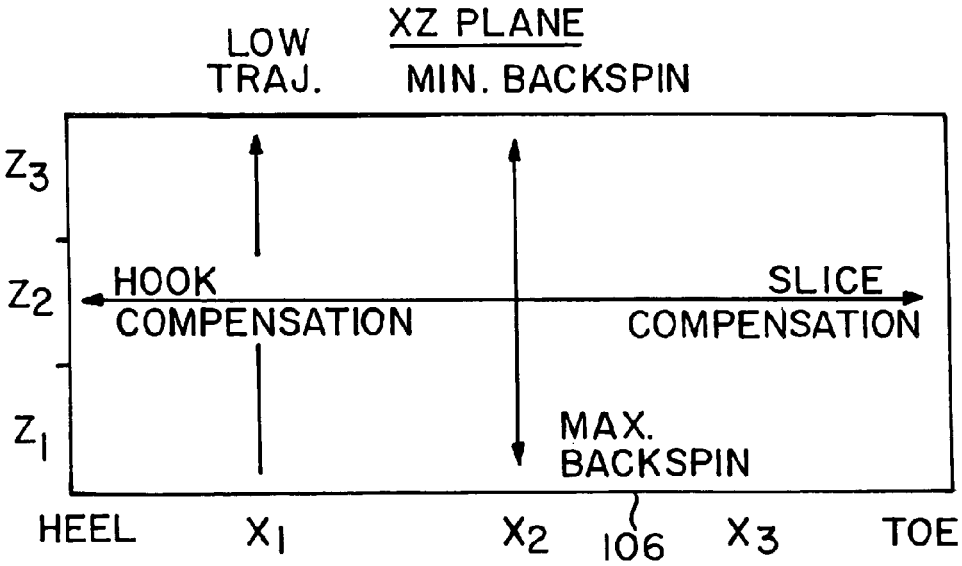
FIG. 4 is a graph showing the golf performance parameters which may be influenced by weighting within the XZ plane of said matrix.
Figure 5:
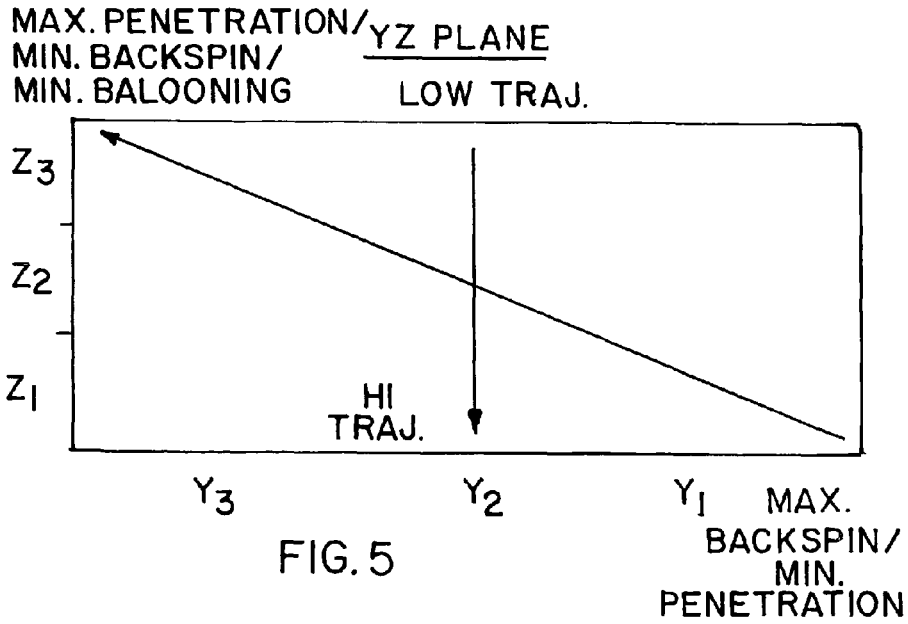
FIG. 5 is a graph showing the club performance characteristics which may be influenced by weighting within the YZ plane of said matrix.

In the charts of FIGS. 3-5 are shown the XY, XZ and YZ coordinate relationships which affect particular parameters of ball strike, path, trajectory and rotation which are of interest to golfers. More particularly, shown in FIG. 3 is the effect of different types of weighting within the XY plane of orthonormal matrix 112, that is, the horizontal plane thereof. Therein, weighting in the +X or toe direction will increase ballooning of flight path of the golf ball, so that +X weighting direction of the club head will also provide for slice (right curvature) compensation of the golf ball. See FIG. 3. Conversely, weighting toward the heel or in the −X direction will provide for hook (left curvature) compensation. FIG. 3 also indicates that maximum backspin of the ball may be achieved by weighting at a low y position, that is, near the plane of the face plate, while minimum back spin may be accomplished through weighting toward the rear of the club head, this corresponding to the Y3 position.

With reference to FIG. 4, one may note that hook or slice compensation, as in FIG. 3, remains a function of the weighting along the X-axis. In the XZ plane which is a vertical plane co-parallel with club hosel 108, trajectory may be controlled as a function of position of weighting upon the z-axis, that is, the lowest z-axis position (Z1) will afford the highest trajectory, whereas the highest z-axis position (Z3) will produce the lowest trajectory of ball flight.

Backspin of the ball is also a function weighting along the Z-axis. As may be noted by the line at the middle of FIG. 4, the Z1 position will produce a maximum spin of the ball, while weighting at Z3 will produce a minimum backspin. Accordingly, viewing FIGS. 3 and 4 in combination, it may be appreciated that a minimum backspin may be achieved by weighting at the (X2, Y3, Z3) coordinate, while maximum backspin may be achieved by weighting at the (X2, Y1, Z1) coordinate, as will also be illustrated in the figures which follow.

Figure 6:
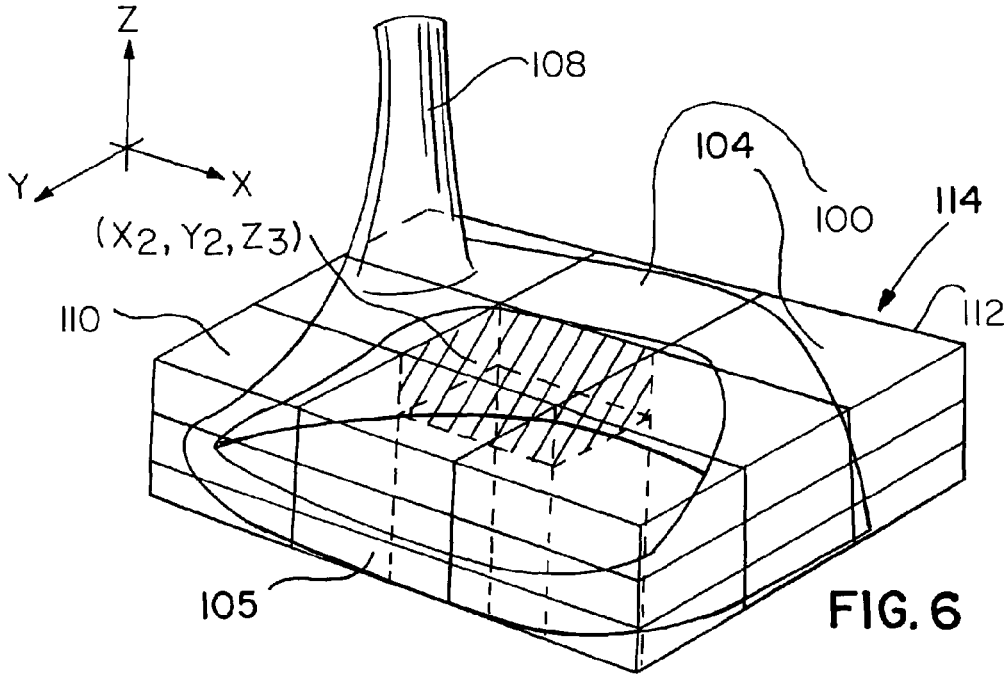
FIG. 6 is an illustration of a weighting of a club head of the type of FIG. 1 at a (X2, Y2, Z3) coordinate of said matrix.

With reference to FIG. 5, this chart corresponds to the YZ plane which is a vertical plane substantially parallel with toe face 110 of the club (see FIGS. 2 and 6).

From FIG. 5, it may be noted that minimum penetration, that is, maximum apex of ball flight, is achieved at the (Y1, Z1) position, while maximum penetration is achieved at the (Y3, Z3) position. Further, the highest trajectory may be seen to exist at the (Y2, Z1) position, while the lowest trajectory is achieved at the (Y2, Z3) position. Minimum backspin and minimum ballooning are achieved at (Y3, Z3) and maximum backspin and maximum ballooning at (Y1, Z1).

With the above in mind, the weighting coordinate (X2, Y2, Z3), which is shown in FIG. 6, should be appreciated as one that does not provide for either hook or slice compensation but which provides for reduced trajectory (flatter path of ball flight) and some decrease in backspin due to the Z3 part of the coordinate shown.

Figure 7:
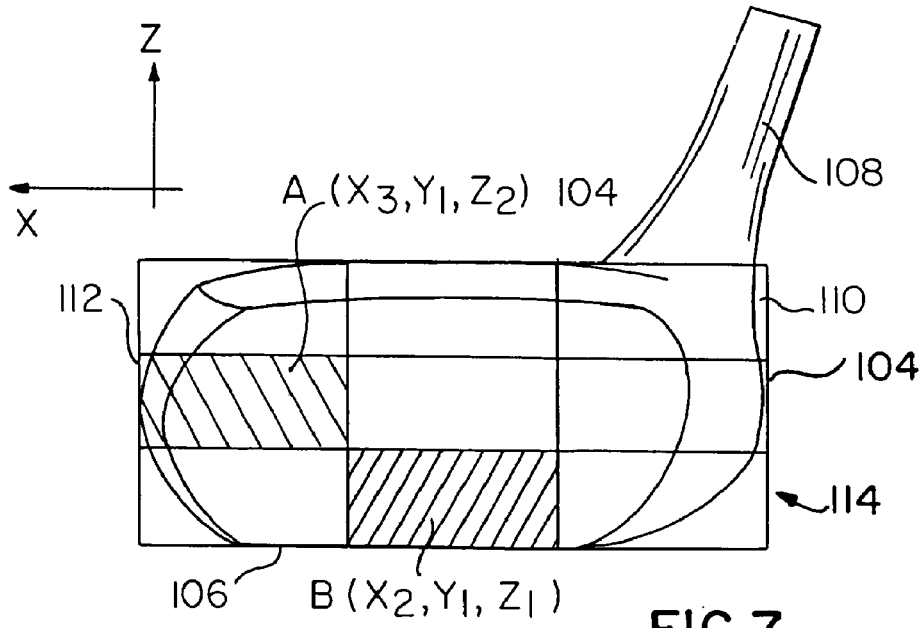
FIG. 7 is a front plan view of the club of FIG. 1 showing weighting at a (X3, Y1, Z2) coordinate and at a (X2, Y1, Z1) coordinate.

In FIG. 7 are shown two different weighting coordinates, both within the Y1 region which includes the plane of face plate 104 of the club head, but in diagonal relationship to each other. More particularly, a weighting element A shown to the left of FIG. 7 is the (X3, Y1, Z2) position and affords neutral ballooning, slice compensation, and some additional backspin. In distinction, weighting element B of coordinate (X2, Y1, Z1) provides for high trajectory, maximum backspin and minimum penetration.

Figure 8:
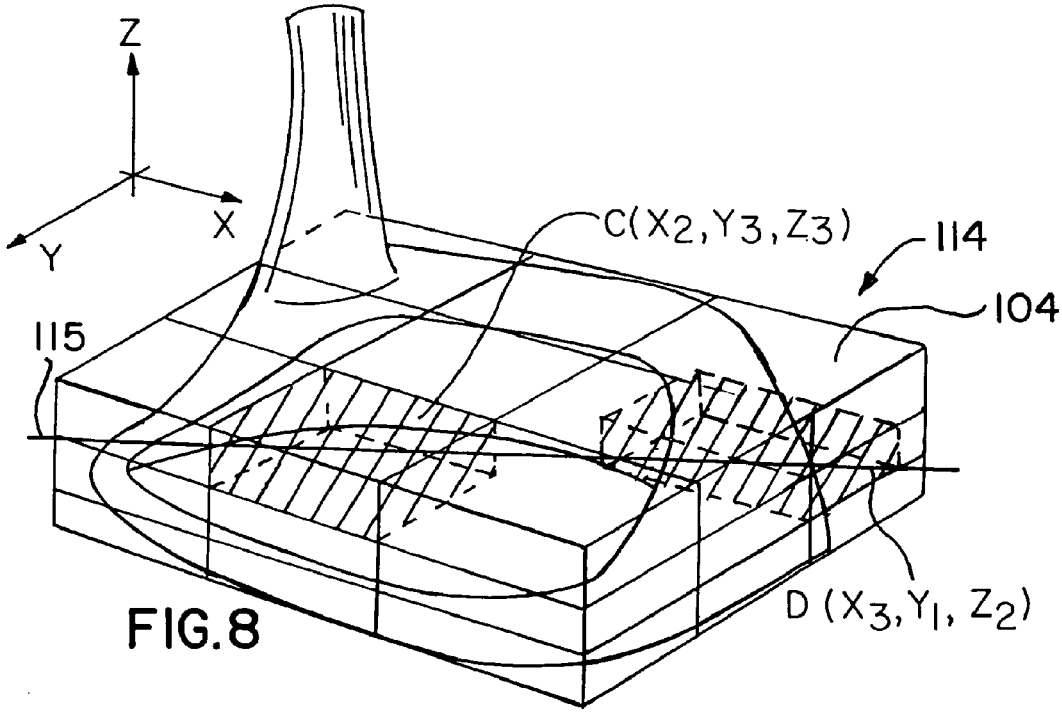
FIG. 8 is a view, similar to that of FIG. 6, however showing weightings in a diagonal relationship in the club of FIG. 1, that is, at a (X2, Y3, X3) coordinate and at the (X3, Y1, Z2) coordinate.

With reference to FIG. 8, two weighting elements XY and YZ are shown in diagonal relation to each other along an axis 115. Therein, weighting element C (coordinate X2, Y3, Z3) provides for low trajectory, minimum backspin and maximum penetration, while element D of FIG. 8 provides for minimum ballooning of ball flight, slice (right curvature) compensation and medium trajectory. Note that element D does not touch faceplate 104, that is, the Y=0 position of the coordinate system. See also FIG. 3. Elements C and D may be adjustably secured within a channel along said axis 115 between said elements.

Figure 9:
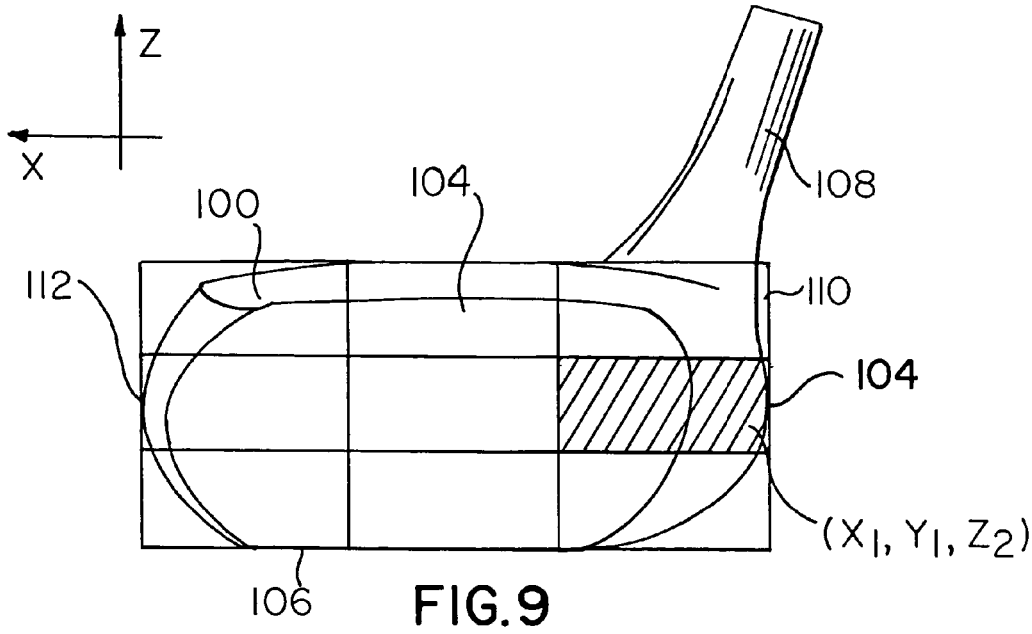
FIG. 9 is a view, similar to that of FIG. 7, however showing weighting at a (X1, Y1, Z2) coordinate.

With reference to the weighing element at (X1, Y1, Z2) shown in FIG. 9, such an arrangement will provide for neutral ballooning, hook compensation, slightly additional backspin and medium trajectory. Note that said weighting element does not abut face plate 104.

Figure 10:
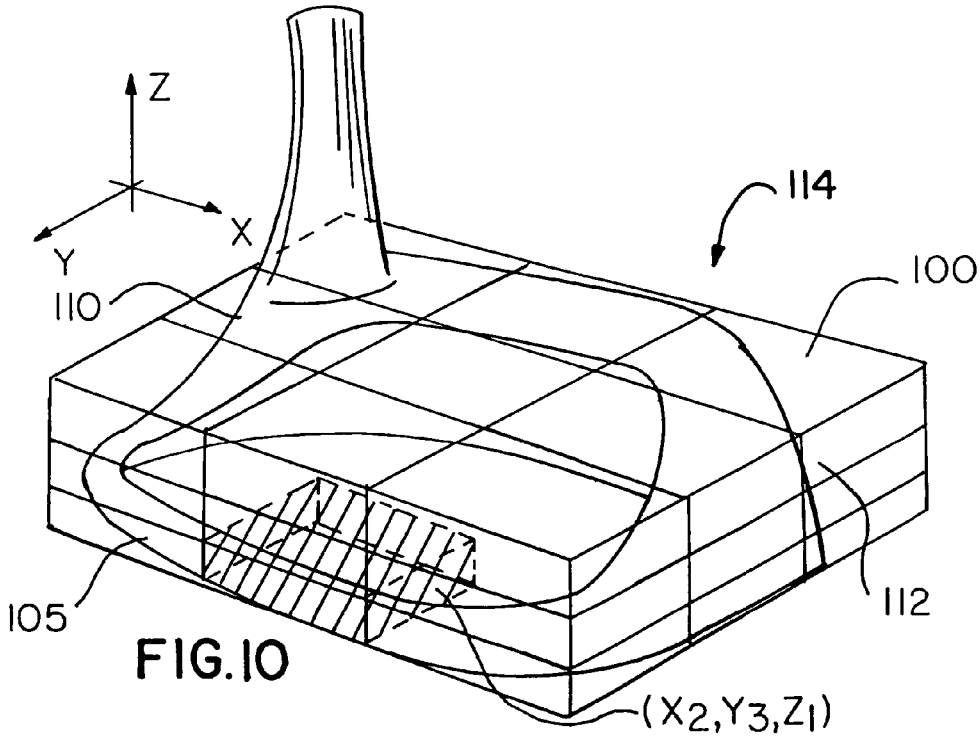
FIG. 10 is a view, similar to that of FIG. 6, however showing weighting at a (X2, Y3, Z1) position.

The weighting element (X2, Y3, Z1) shown in FIG. 10 affords high trajectory, high backspin and high penetration, although not as high penetration as would exist were the weighting at the (X2, Y3, Z3) position.

Figure 11:
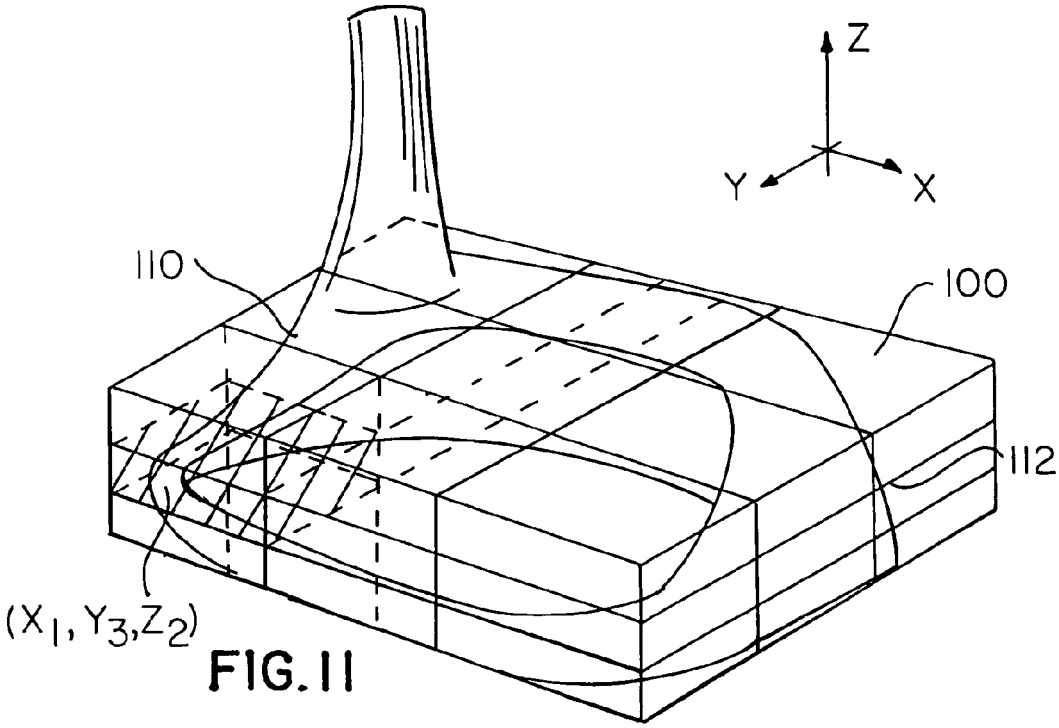
FIG. 11 is a view similar to that of FIG. 6, however showing weighting at a (X1, Y3, Z2) coordinate.

Shown in FIG. 11 is a weighting element at the (X2, Y3, Z2) position. Thereby, there is achieved hook compensation, high penetration and, no change in the ball's natural trajectory.

Figure 12:
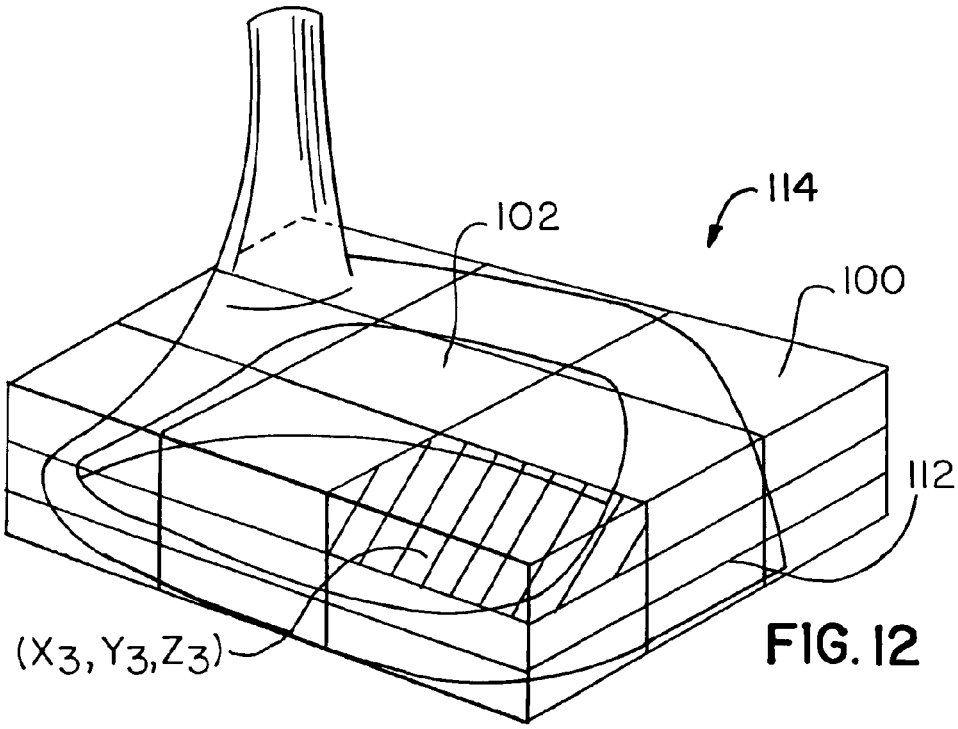
FIG. 12 is a view, similar to that of FIG. 6, however showing weighting of the club head at a (X3, Y3, Z3) coordinate of the orthonormal matrix.

In the weighting scheme shown in FIG. 12, that is, weighting at the (X3, Y3, Z3) coordinate position, one achieves slice compensation, decreased backspin, low trajectory and maximum penetration. The weighting elements shown in FIGS. 2, and 6-12, may be secured within void space 102 of head 100 by any number of means including threaded channels, tracks, rods, low density, foam, and combinations thereof. See FIGS. 14A and 14B below.

Figure 13:
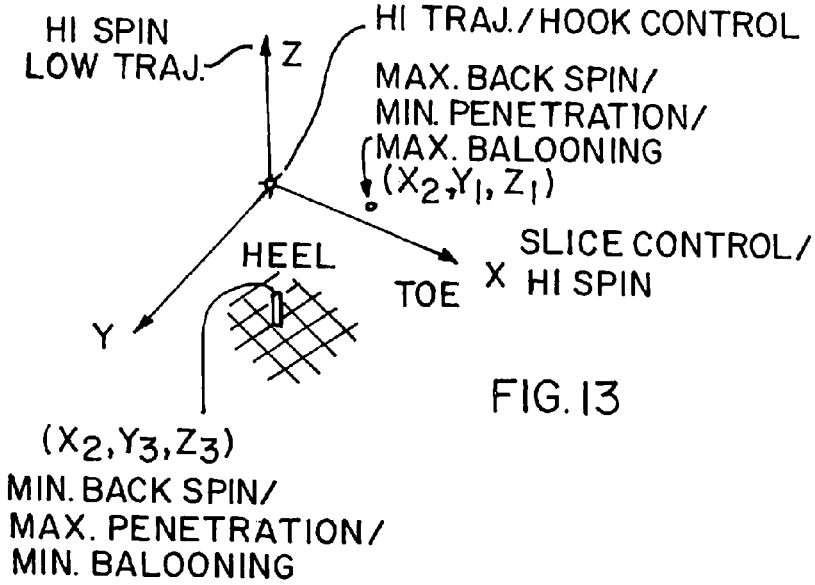
FIG. 13 is a three-dimensional graph showing the effect of weighting at different combinations of the X, Y, and Z coordinates of the orthonormal matrix and the parametric results of such weighting.

Three-dimensional relationships of the above-described parameters of backspin, penetration, trajectory and ballooning are illustrated in FIG. 13. It may be appreciated that ballooning control occurs primarily as a function of the Y and Z axes and maximum backspin occurs as a function of weighting at the (Y1, Z1) position with minimum backspin occurring with weighting at the (Y3, Z3) position. Penetration is also a function of the combined effect of two axes, that is, maximum penetration occurring with weighting at the (Y3, Z3) position and minimum penetration occurring with weighting at the (Y1, Z1) coordinate.

Figure 14:
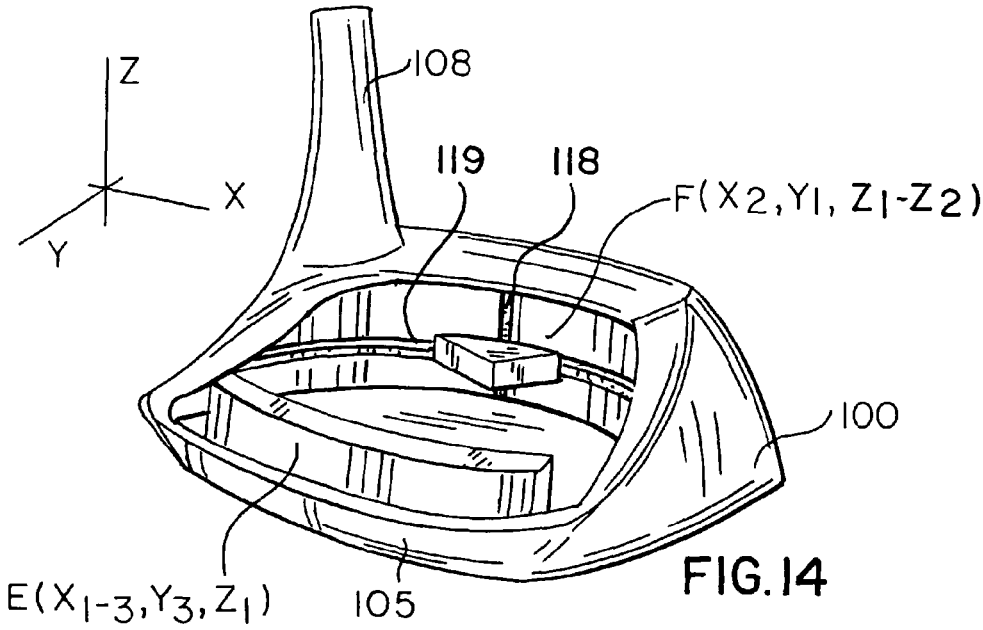
FIG. 14 is a view of a club head of the type of FIG. 1, however showing the use of multiple weights across multiple coordinates.

In FIG. 14 is shown the use of weights E and F in two different areas of the golf club head 100 of FIG. 1. Therein, a good player would move weight E to the back of the club head to achieve as penetrating a shot as he could, and would also position weight F to reduce the spin, putting additional weight in the X-axis center (X2) of the club head. This makes the sweet spot smaller, that is, the player must strike the ball right at the center (X2). That is, an ideal strike which would result in the best transference of energy from club to ball. However, it causes a largest margin of error. Such a golfer therefore would need to be a rather good player to move weight F to the center of the face. Said weight E also maximizes penetration. Element F may be adjustable secured on a vertical track 118 or a horizontal track 119, and element E may have a variable density in an X axis.

Figure 14A:
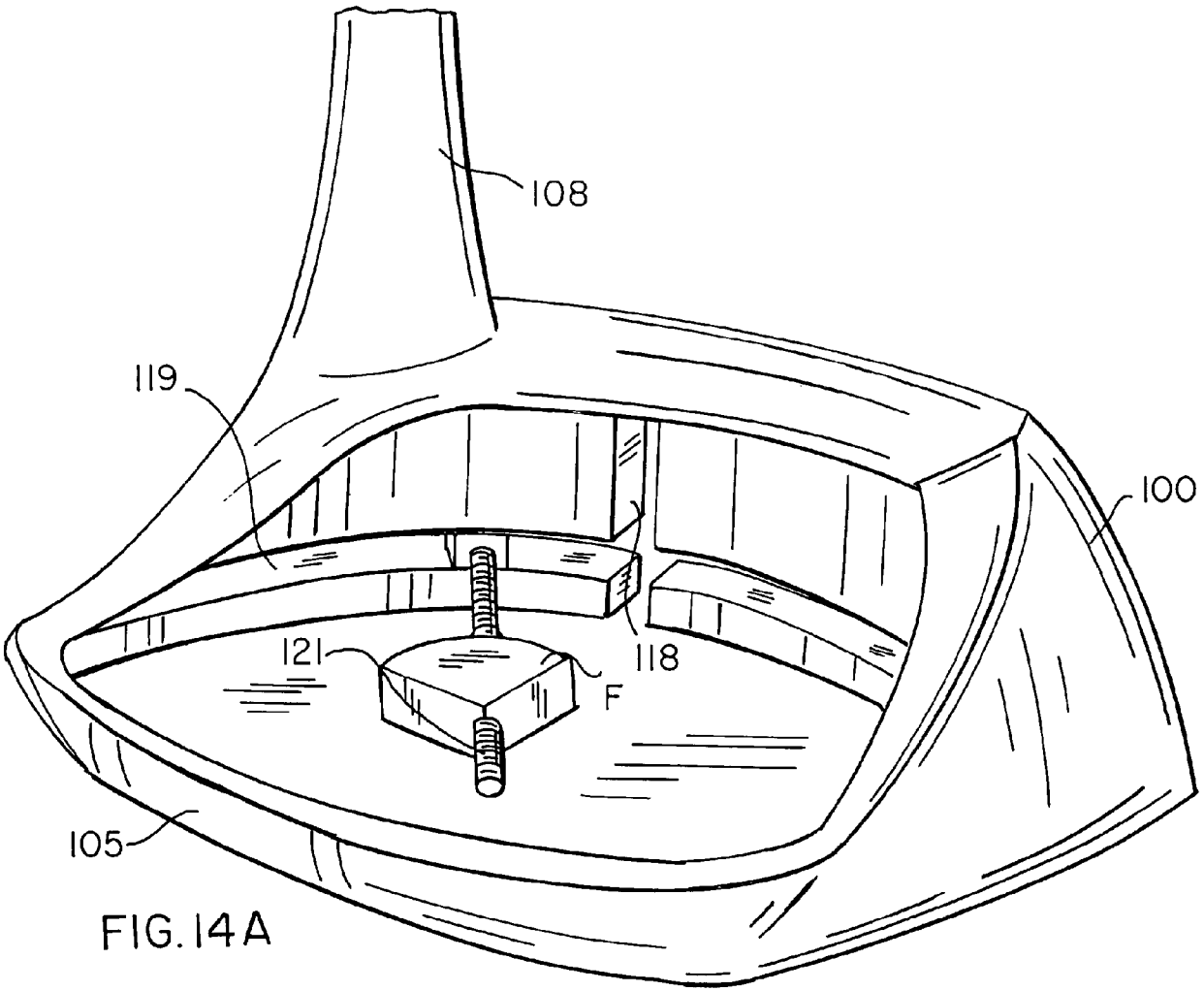
FIGS. 14A and 14B are alternative versions of the embodiment of FIG. 14, showing a diagonal relationship of weighting elements as in FIG. 8.

FIG. 14A presents a variation of the embodiment of FIG. 14 in which a threaded bolt 121 is provided, onto which element F may be threaded to a desired coordinate in the XY plane after a desired location of a secured end 121A, within track 118 or 119, has been established. This provides XY plane adjustability in the manner shown schematically in FIGS. 3, 13 and 23.

Figure 14B:
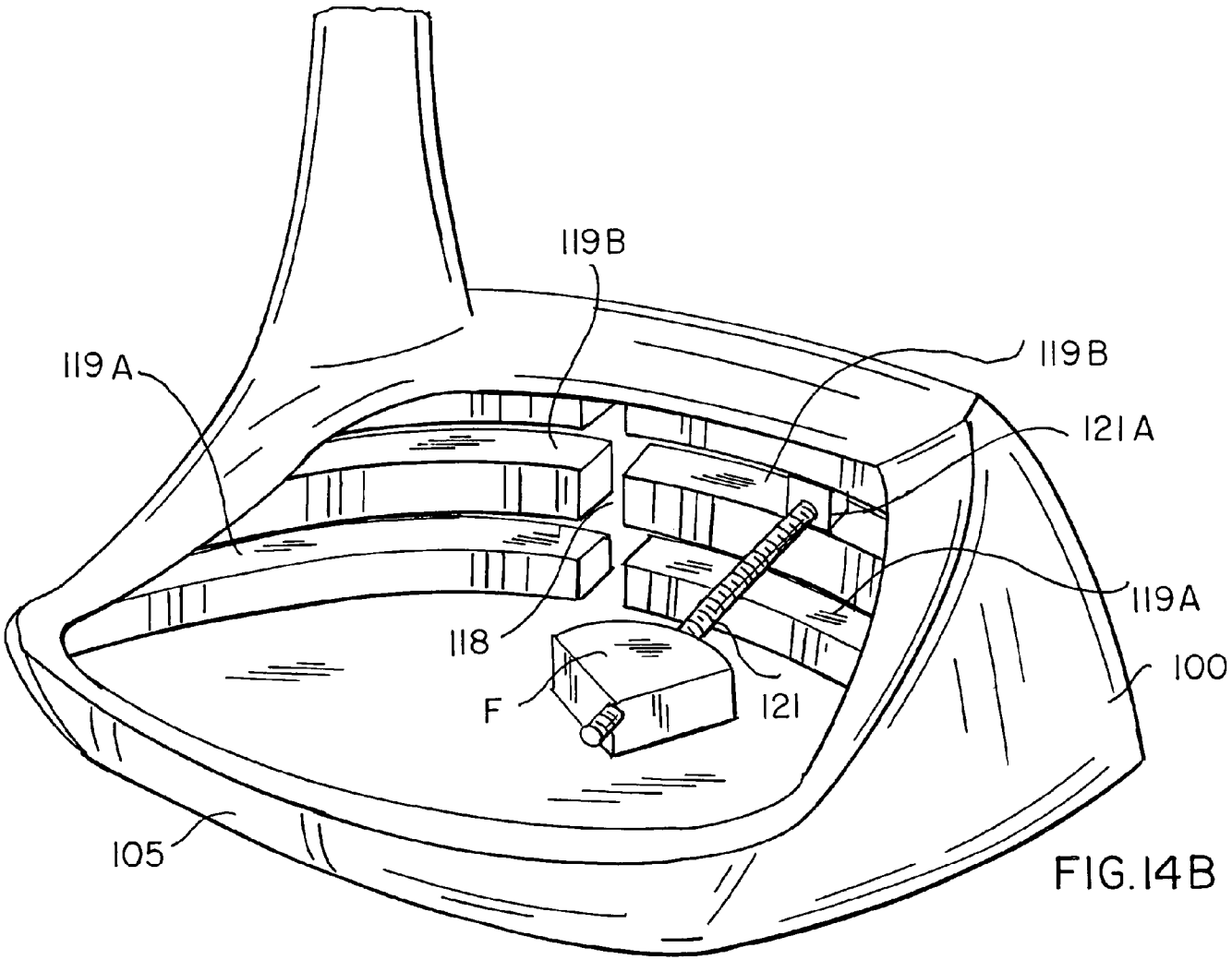

FIG. 14B is another variation of the embodiment of FIG. 14 in which two horizontal tracks 119A and 119B are provided to achieve different Z-axis adjustments. The embodiments of FIGS. 14A and 14B may be employed either with or without strip-like element E of FIG. 14, or a smaller such strip may be provided at any segment along trading edge 105 of the club.

Figure 15:
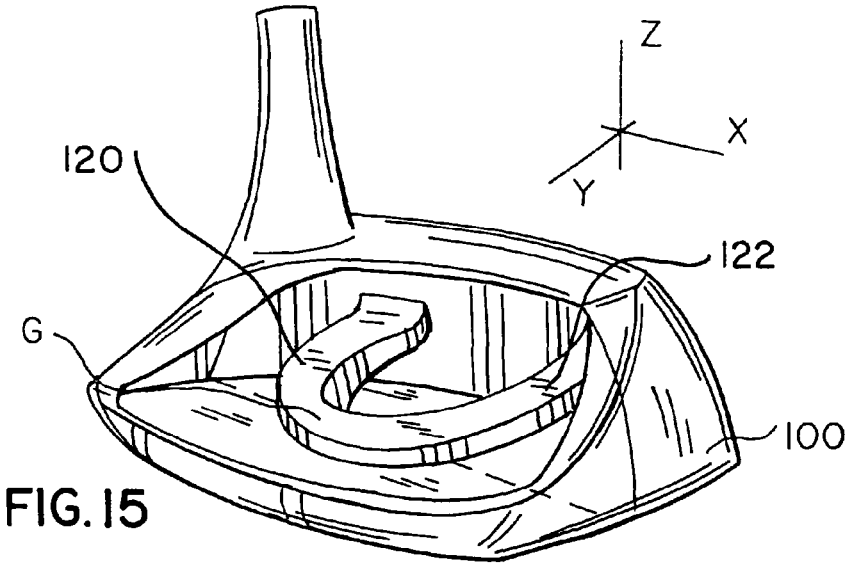
FIG. 15 is a view, the use of a horse shoe weighting element to broaden the sweet spot and to achieve other modifications of ball flight performance.

In FIG. 15 is shown the effect of a horse shoe-like structure G, symmetric about the YZ plane at the X2 position. This helps the basic or average player. Such a player moves the weight toward the heel and the toe 112 to make his sweet spot as wide as possible. Structure G also moves the weight down toward the back to get some height on the ball, and also to get more penetration to pick-up some distance. This would be a club for a basic, standard player who simply needs some help that is not interested in slice hook combination. It's just addressing trajectory and spin rate. Arm 120 of element G may exhibit a greater mass than area arm 122 to provide X axis, i.e., hook-slice compensation.

Figure 16:
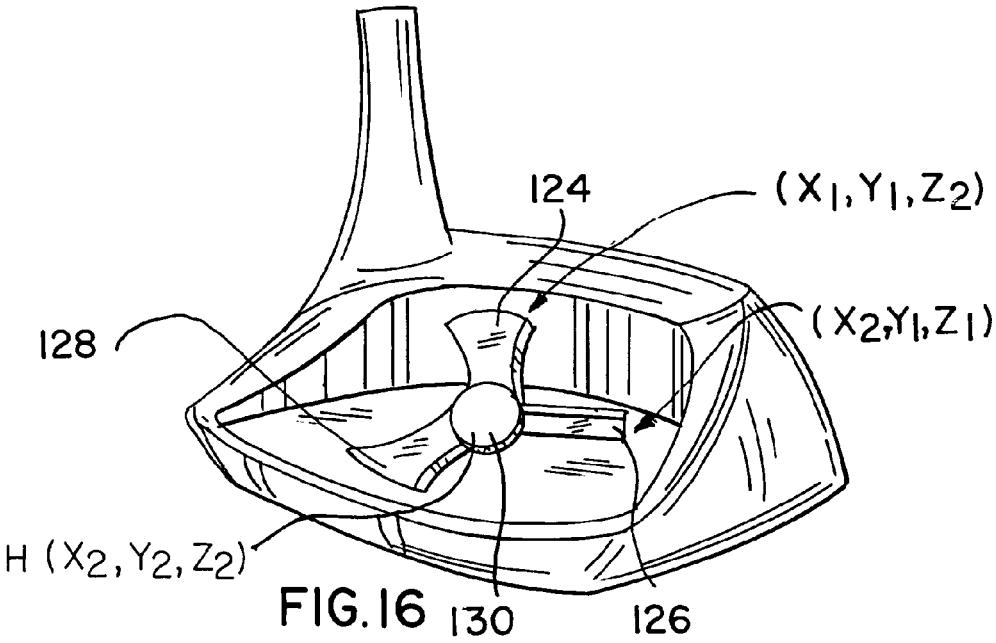
FIG. 16 is s a view showing the use of a propeller type weighting element to modify golf club performance.

With reference to FIG. 16, there is shown the use of a propeller type weight H, having its center at (X2, Y2, Z2), which would be used if one were hitting the ball a bit to the left and low. To compensate for that, the weight is moved to the left, so that the ball will move to the right. To counteract the moving the weight to the left, one may place a projection of the weight H down toward the right hand corner to get the ball up into the air again, and to also move another projection to the rear for penetration and movement up in the air. One or more arms 124, 126 and 128 of element H may be made of different density materials, masses and/or geometries to afford X, Y, Z adjustability of ball flight characteristics. The arm 124 provides hook adjustment at the (X1, Y1, Z2) coordinate. Arm 126 provides maximum ballooning at the (X2, Y1, Z1) coordinate. The location of center 130 of weight H will affect flight characteristics as shown in FIGS. 3, 4, 5 and 13.

Figure 17:
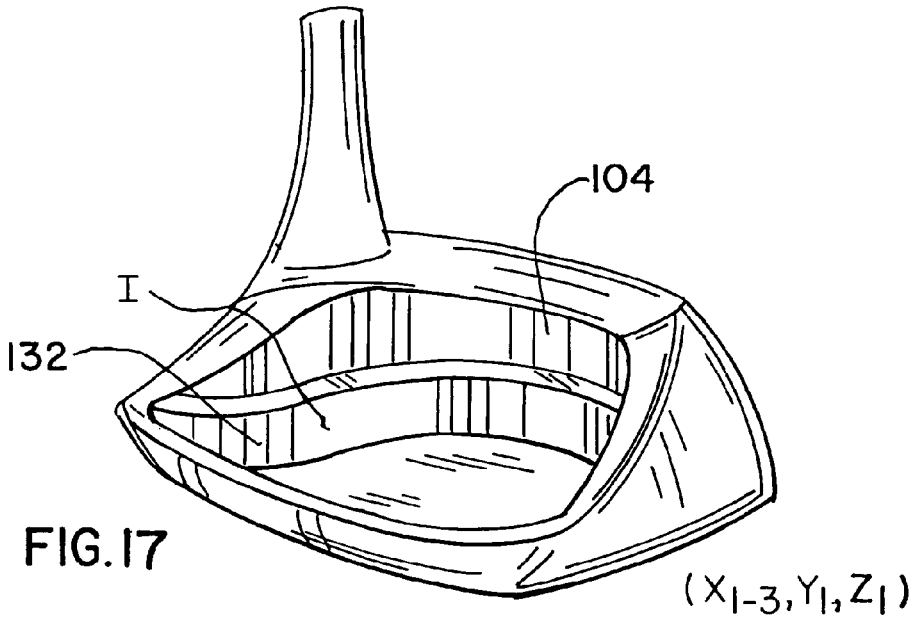
FIG. 17 is a view in which a strip-like element is used to modify club performance.

With reference to FIG. 17, there is shown the use of a saddle-like weighting element I inserted along the sides and behind the face plate, but preferably not abutting it. The benefits of such a weighting geometry are that the weight is set to hit the ball a little higher because the weight is low. It also tends to give it a bit more of penetration, because the weight is moved back. By also moving it to the left, one pushes the ball out to the right, tending to give a shot slightly to the right and is penetrating, but yet will have some spin on it. So it starts out low, goes right and then slows down. Further, left side 132 of element I may have a greater mass than the opposite side if heel weighting is desired.

The following charts relate coordinates of the above weighting coordinates to the figures, by planes of the orthornomal matrix.

CHART 1

(xy plane)

Figure 23:
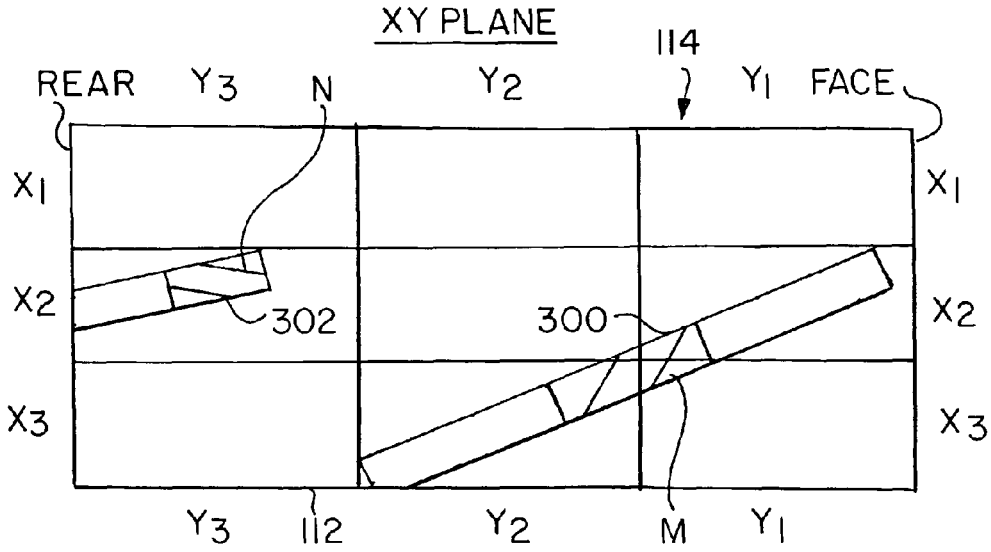
FIGS. 23-24 show an embodiment, further to that of FIGS. 8 and 14, in which the concept of adjustable weighting elements along diagonals in the XY and YZ planes is shown, these figures generally corresponding to FIGS. 3 and 5 above.

| | X1 (heel) | X2 | X3 (toe) |
|---|---|---|---|
| Y1 | FIG. 9 | FIGS. 7 Element B)<br>14 (Element F) | FIGS. 7<br>(Element A),<br>8 (Element D) |
| Y2 | | (Element H)<br>FIGS. 2, 6, 16 | FIG. 23<br>(Element M) |
| Y3 | FIGS. 11, 14<br>(Element E) | FIGS. 8<br>(element C), 10<br>14 (Element E)<br>23 (Element N) | FIGS. 10,<br>14 (Element E) |

CHART 2

(XZ plane)

| | X1 (heel) | X2 | X3 (toe) |
|---|---|---|---|
| Z1 (heel) | | FIGS. 7 (Element B),<br>10, 16 | |
| Z2 | FIGS. 9, 11 | FIGS. 2, 14<br>(Element F) | FIGS. 7<br>(Element) A)<br>8 (Element D) |
| Z3 | | FIGS. 6, 8<br>(Element C) | FIG. 10 |

CHART 3

(yz plane)

Figure 24:
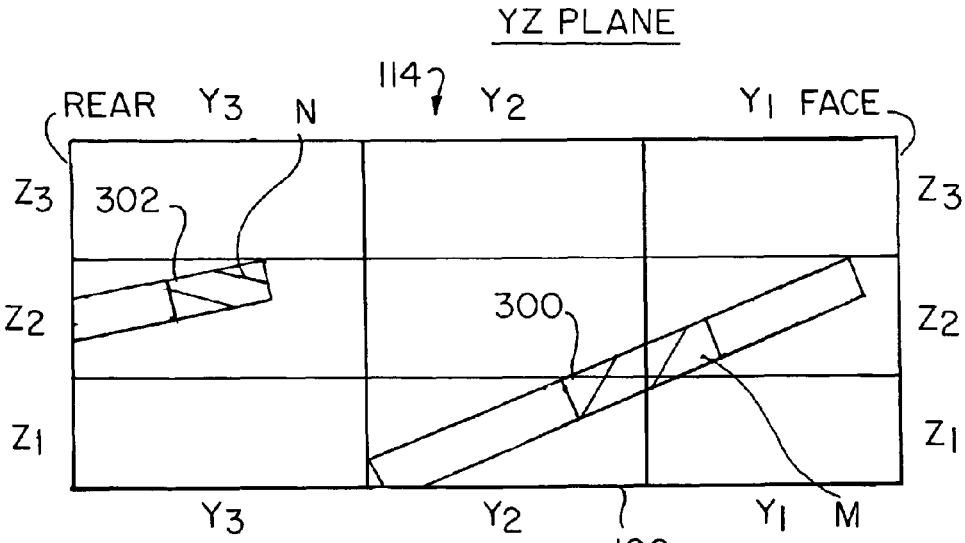

| | Y1 (face) | Y2 | Y3 (rear) |
|---|---|---|---|
| Z1 | FIG. 7 (Element B) | FIGS. 16, 24<br>(Element M) | FIGS. 10, 14<br>(Element E) |
| Z2 | FIGS. 7 (Element A),<br>8 (D), 9 | FIG. 5 | FIGS. 11, 24<br>(Element N) |
| Z3 | | FIG. 6 | FIGS. 8<br>(Element C),<br>12 |

Figure 18:
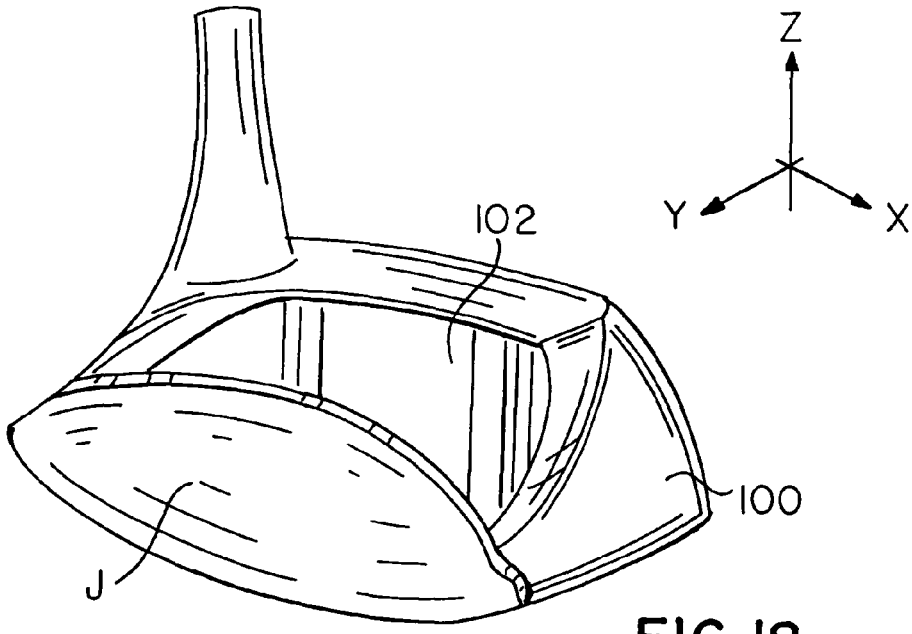
FIG. 18 illustrates the use of a clip-on element to achieve particular modifications of golf strike and ball flight characteristics.
Figure 19:
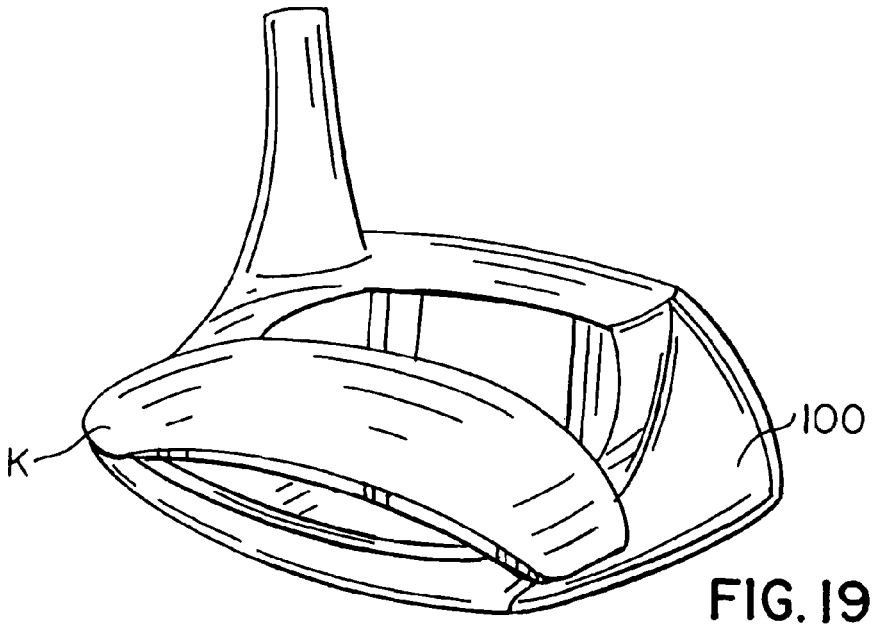
FIG. 19 shows a further snap-on element to provide different performance characteristics.
Figure 20:
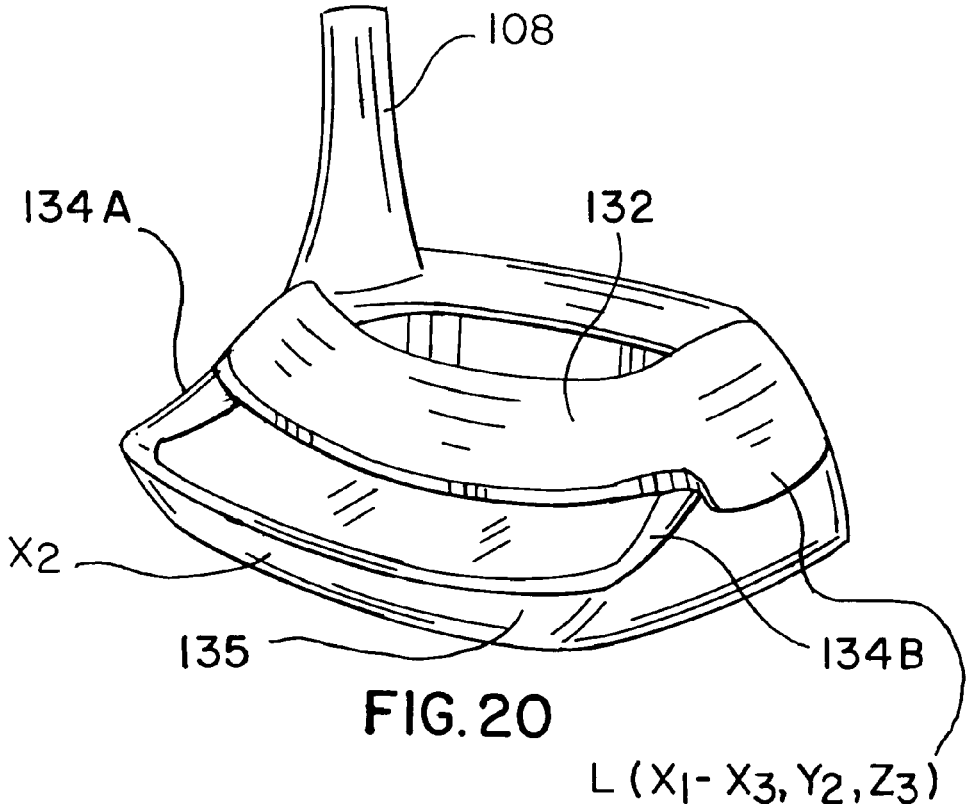
FIG. 20 shows a yet further snap-on weighting element for the modification of ball strike characteristics.
Figure 18A:
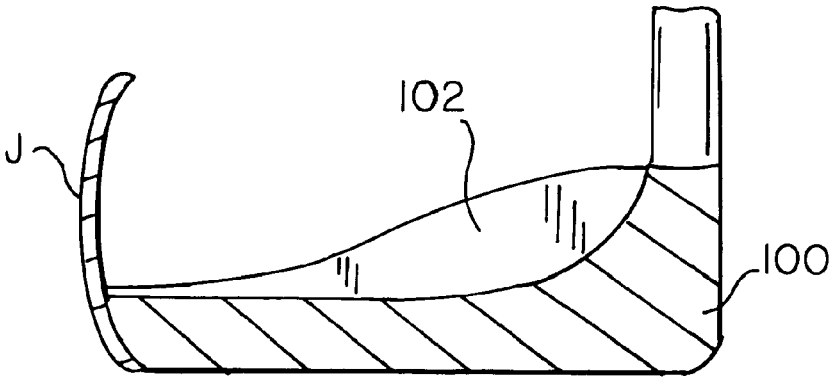
FIG. 18A is a side cross-sectional view of the embodiment of FIG. 18.

In FIGS. 18-20 are shown the use of clip-on type weighting elements. More particularly, a weighting element J of FIG. 18 moves weight to the rear of the club head, thus increasing penetration, while lowering the center of gravity of the club head and increasing spin. Element J may be convex or concave, thus affecting Y-axis weighting, and J may exhibit an X or Z, an axis of selectably variable density. Its height may also vary. FIG. 18A is a side cross-sectional view of FIG. 18 along the X2 portion of the club head 100.

In a weighting element K of FIG. 19, weight is not moved back as far, and is raised-up slightly higher than that of element J, particularly at the X-axis center thereof, thus ensuring reduced ballooning because of the high Y, high Z weighting at the mid-X position. See also FIG. 5. It is noted that element J spans all X-axis positions, as well as the Y2 and Y3 locations, thereby providing a hook/slice neutral correction of weighting, this as opposed to the slice (right curvature) compensation of element D (FIG. 8) that is combined with the reduced ballooning effect of element C thereof. This also reduces penetration with slightly reduced backspin, the result being a more controllable ball strike.

In FIG. 20, weighting element L provides a selectable angle elevation of weight element L 132 along edges 134A and 134B, thereby raising or lowering trajectory and widening the sweet spot, as in element G of FIG. 15. It is noted that element L can also be positioned anywhere along edges 134A/B. Also, if element L is asymmetric to the right of a YZ plane of symmetry thru location X2, slice compensation is also provided. In a high position on edges 134, low penetration is attained. In a lower position, high penetration is achieved. Movement of Element L relative to edge 134 also shows diagonally adjustable weighting in YZ plane. See FIGS. 5 and 24.

It is noted that many of the above functions of the weighting elements may be achieved thru variation in weight and dimension of sole portion 106 (see FIG. 1). For example, if a change in weight is indicated at a (X, Y, Z1) coordinate, a change in weight or weight-distribution in the sole portion will affect the parameters shown in the chart of FIG. 3. Also, as may be noted in FIG. 4, addition or reduction of weight at Z1 will affect trajectory and backspin.

Figure 21:
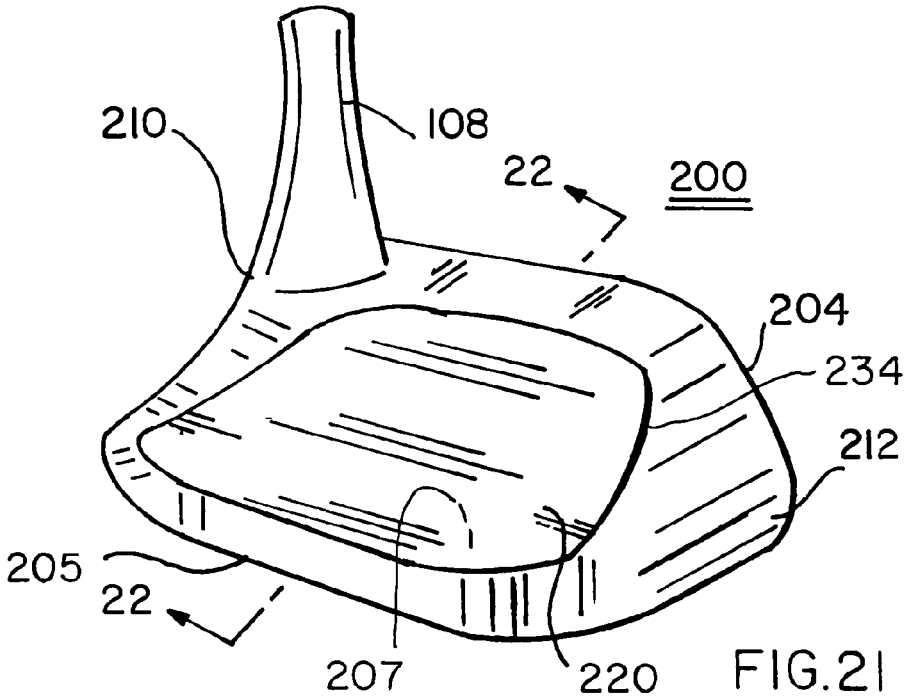
FIG. 21 shows use of an enclosure or cover over the void space of the club head.
Figure 22:
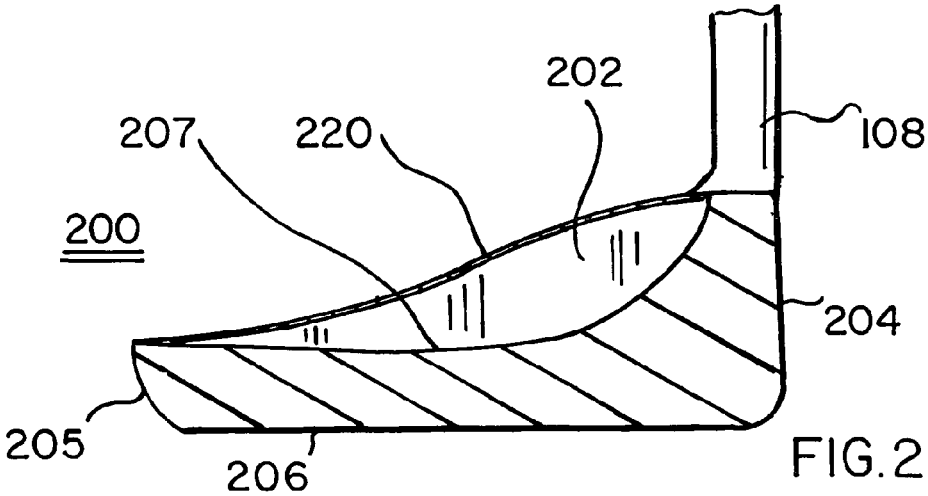
FIG. 22 is a cross-sectional view taken along Line 22-22 of FIG. 21.

Shown in FIGS. 21 and 22 is a further embodiment 200 of the invention in which void space 202 is covered by an enclosure 220 which may be attached either permanently or by snap-fit over the void space and surface 207 of sole portion 206 and trailing edge 205 thereof. Also shown in FIGS. 21 and 22 is face plate 204, heel 210, toe 212 and hostel 108.

In FIGS. 23 and 24 are shown weighting strategies further to that of FIGS. 8, 14, 14A, 14B and 20, showing another diagonal XYZ matrix weighting strategy. As may be seen, a single movable element M may furnish weighting at any segment along a vector that includes the (X3, Y2, Z1) and the (X3, Y1, Z2) coordinates and is also defined by a channel 300. Said vector exhibits a down-to-up and rear-to-face direction. Another movable element N may furnish weighting along a vector including the (X2, Y3, Z2) coordinate in channel 302, that is, a channel starting at the rear of the club head. Such diagonal weighting is an effective way of obtaining multiple club performance objectives using a small number of weights, each movable within a single channel. Multiple channels may be optionally used. In this embodiment the location or use of elements M and N, each having different weights, can be exchanged between channels 300 and 302 for different club performance effects.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. In a virtual 3×3×3 X, Y, Z orthonormal coordinate system comprising 27 volumetric coordinates in which a face plate of a golf club head intersects a forward-most XZ plane of said system, in which a heel and hosel side of said golf club head intersects a YZ plane thereof substantially at an origin of said coordinate system, and further in which an increase in X-axis value from X1 to X3 corresponds to a direction of a toe of said golf club head, with each of X1, X2 and X3 representing one third of said golf club head in the X-axis; an increase Y-axis value from Y1 to Y3 corresponds in direction to a rear of said golf club head, with each of Y1, Y2 and Y3 representing one third of said golf club head in the Y-axis; and an increase in Z-axis value from Z1 to Z3 corresponds to an increase in height above a bottom-most XY plane, with each of Z1, Z2 and Z3 representing one third of said golf club head in the Z-axis; a golf club adjustment system comprising:

(a) said club head having a void space behind said face plate of said golf club and above said sole portion thereof, said void space substantially conformal in geometry to that of said club head; and (b) two selectable golfer replaceable weighting elements secured within said void space, wherein at least one weighting element thereof is not contiguous to any part of said face plate, and a selected coordinate value upon the Y-axis in any one of said weighting elements does not equal a selected coordinate value of Y of at least a second one of said weighting elements, and wherein at least one selected weighting element is recessed within said void space and disposed at a position having a coordinate of X2 and a coordinate of Z2.

2. The system as recited in claim 1, in which said at least one selected weighting element disposed at said position having a coordinate of X2 and a coordinate of Z2 has a coordinate of Y2.

3. The system as recited in claim 1, in which said at least one selected weighting element disposed at said position having a coordinate of X2 and a coordinate of Z2 has a coordinate of Y1.

4. The system as recited in claim 1, in which said at least one selected weighting element disposed at said position having a coordinate of X2 and a coordinate of Z2 has a coordinate of Y3, and is recessed from a surface of said voice space at a rear-most XZ plane.

5. The system as recited in claim 1, in which one or more of said weighting elements is non-uniform along one or more of said X, Y or Z axis thereof.

6. The system as recited in claim 1 further comprising a third weighting element.

7. The system as recited in claim 1, in which a first selected element is integral with a part of a second selected weighting element.

8. The system as recited in claim 1, further comprising an enclosure over said void space of said club head.

9. The system as recited in claim 1, in which said selectable weighting elements are secured within said void space by bars, bolts, threadable bolts, or slots within a surface defining said void space, channels or foam provided about said weighting elements.

10. In a virtual 3×3×3 X, Y, Z orthonormal coordinate system comprising 27 volumetric coordinates in which a face plate of a golf club head intersects a forward-most XZ plane of said system, and in which a heel and hosel side of said club head intersects a YZ plane thereof substantially at an origin of said coordinate system, and further in which an increase in X-axis value from X1 to X3 corresponds to a direction of a toe of said club head, with each of X1, X2 and X3 representing one third of said club head in the X-axis; an increase in Y-axis value from Y1 to Y3 corresponds in direction to a rear of said club head, with each of Y1, Y2 and Y3 representing one third of said club head in the Y-axis; and an increase in Z-axis value from Z1 to Z3 corresponds to an increase in height above a bottom-most XY-plane with each of Z1, Z2 and Z3 representing one third of said club head in the Z-axis; a golf club adjustment system comprising:

(a) said club head having a void space behind said face portion of said club head and above said sole portion thereof, said void space substantially conformal in geometry to that of said club head;

(b) a golfer replaceable weighting element within said void space between a higher Y, higher Z coordinate, to minimize ballooning, to a lower Y, lower Z coordinate to maximize said ballooning; and (c) a golfer replaceable weighting element recessed within said void space disposed at a position having a coordinate of X2 and a coordinate of Z2.

11. The system as recited in claim 10 further comprising:

(d) at least one of the following weighting elements, in which a selected value of X, Y or Z does not include a value of Y of said weighting element in (b), said at least one element comprising:

(i) a weighting element, substantially within said void space, between a lower Y, lower Z coordinate, to increase backspin, to a higher Y, higher Z coordinate to decrease backspin; or (ii) a weighting element substantially within said void space, between a lower Z-coordinate to increase trajectory to a higher Z-coordinate to decrease trajectory.

12. The system as recited in claim 11, in which any selected value of Y of said weighting element in (d) is not contiguous with any part of said face plate.

13. The system as recited in claim 10, in which said weighting element of said at least one of said elements in (b) or (c) is non-uniform along one or more of said X, Y and Z axes.

14. The system as recited in claim 10, in which a first selected element is integral with a second selected element.

15. The system as recited in claim 10 further comprising: an enclosure over said void space of said club head.

16. The system as recited in claim 10, in which said selectable weighting elements are secured within said void space by bars, bolts, threadable bolts, or slots within a surface defining said void space, channels or foam provided about said weighting elements.

17. A system for adjusting the performance of a golf club including a golf club head having a center of gravity and to which a virtual 3×3×3 X, Y, Z orthonormal coordinate system comprising 27 volumetric coordinates may be applied such that a face plate of said club head intersects a forward-most XZ plane of said system, and in which a heel and hosel side of said club head intersects a YZ plane thereof substantially at an origin of said coordinate system, and further in which an increase in X-axis value from X1 to X3 corresponds to a direction of a toe of said club head, with each of X1, X2 and X3 representing one third of said club head in the X-axis; an increase Y-axis value from Y1 to Y3 corresponds in direction to a rear of said club head, with each of Y1, Y2 and Y3 representing one third of said club head in the Y-axis; and an increase in Z-axis value from Z1 to Z3 corresponds to an increase in height above a bottom-most XY plane, with each of Z1, Z2 and Z3 representing one third of said club head in the Z-axis; the system comprising:

(a) at least one void space within said club head, said void space substantially conformal in geometry to that of said club head; and (b) user-replaceable weighting elements for adjusting said center of gravity about a plane defined by Y=aZ of said club head by increasing a mass of said weighting elements at a point within said plane defined by Y=aZ, where a is a scaler number, wherein at least one of said weighting elements is recessed within said void space and disposed at a position having a coordinate of X2 and a coordinate of Z2.

18. The system as recited in claim 17, in which said at least one selected weighting element disposed at said position having a coordinate of X2 and a coordinate of Z2 has a coordinate of Y2.

19. The system as recited in claim 17, in which said at least one selected weighting element disposed at said position having a coordinate of X2 and a coordinate of Z2 has a coordinate of Y1, and is not contiguous to said face plate.

20. The system as recited in claim 17, in which said at least one selected weighting element disposed at said position having a coordinate of X2 and a coordinate of Z2 has a coordinate of Y3, and is recessed from a surface of said voice space at a rear-most XZ plane.

* * * * *